US007281784B2

(12) United States Patent
Eguchi et al.

(10) Patent No.: US 7,281,784 B2
(45) Date of Patent: Oct. 16, 2007

(54) LIQUID DISCHARGE APPARATUS AND METHOD FOR DISCHARGING LIQUID

(75) Inventors: Takeo Eguchi, Kanagawa (JP); Kazuyasu Takenaka, Tokyo (JP); Yuichiro Ikemoto, Kanagawa (JP)

(73) Assignee: Sony Corporation, Tokyo (JP)

( * ) Notice: Subject to any disclaimer, the term of this patent is extended or adjusted under 35 U.S.C. 154(b) by 334 days.

(21) Appl. No.: 10/774,215

(22) Filed: Feb. 6, 2004

(65) Prior Publication Data

US 2004/0196321 A1 Oct. 7, 2004

(30) Foreign Application Priority Data

Feb. 10, 2003 (JP) ..... P2003-032128

(51) Int. Cl.
*B41J 2/09* (2006.01)

(52) U.S. Cl. ..... 347/77

(58) Field of Classification Search ..... 347/74–76, 347/77–80, 9, 19, 37, 40–41, 43, 15, 54
See application file for complete search history.

(56) References Cited

U.S. PATENT DOCUMENTS 5,581,284 A * 12/1996 Hermanson ..... 347/43
6,260,939 B1 * 7/2001 Shioya et al. ..... 347/15
6,354,689 B1 * 3/2002 Couwenhoven et al. ..... 347/19
6,536,873 B1 * 3/2003 Lee et al. ..... 347/54
6,863,361 B2 * 3/2005 Barr et al. ..... 347/19
6,908,176 B2 * 6/2005 Koitabashi et al. ..... 347/43
6,916,077 B2 * 7/2005 Eguchi et al. ..... 347/12

FOREIGN PATENT DOCUMENTS

| | | |
|---|---|---|
| EP | 1 267038 A | 1/2002 |
| EP | WO 02/02331 A1 | 1/2002 |
| JP | 11-207963 | 8/1999 |

* cited by examiner

*Primary Examiner*—K. Feggins
(74) *Attorney, Agent, or Firm*—Sonnenschein Nath & Rosenthal LLP

(57) ABSTRACT

The liquid discharge apparatus includes a head having liquid dischargers capable of deflecting the trajectories of discharged droplets in a plurality of directions. At least two of the liquid dischargers neighboring each other are capable of discharging droplets in the same pixel area. When there is a shut-off liquid discharge due to droplet discharge failure, this information is stored. According to the stored information, the discharge signal corresponding to the droplets the shut-off discharger were supposed to discharge is transferred to another liquid discharger in the vicinity of the shut-off discharger. This other liquid discharger alternatively discharges droplets so that the droplets land in a position the droplets would have had landed if they were discharged by the shut-off discharger.

9 Claims, 12 Drawing Sheets

LIQUID DISCHARGE APPARATUS AND METHOD FOR DISCHARGING LIQUID

RELATED APPLICATION DATA

The present application claims priority to Japanese Application(s) No(s). P2003-032128 filed Feb. 10, 2001, which application(s) is/are incorporated herein by reference to the extent permitted by law.

BACKGROUND OF THE INVENTION

1. Field of the Invention

The present invention relates to a liquid discharge apparatus having a liquid discharger capable of deflecting the trajectory of a droplet in various directions and relates to a method for discharging liquid. More specifically, it relates to a technology for shutting off the operation of a liquid discharger when the discharger fails to discharge droplets and for instructing another liquid discharger to discharge droplets as a replacement for of the shut-off discharger.

2. Description of the Related Art

An inkjet printer, which is a known liquid discharge apparatus, typically has a head including linearly-aligned liquid dischargers. By sequentially discharging minute ink droplets onto a recording medium, such as printing paper, disposed so that it opposes the nozzle surface, a predetermined number of dots are formed on the pixel area to form a pixel.

In some cases, the liquid discharger becomes incapable of discharging droplets normally. This is caused by various reasons.

One reason is discharge failure caused by dust blocking the droplet outlet of the nozzle of the discharger. A known method for solving this problem is head cleaning.

Another reason for discharge failure is caused by clogging of the liquid discharger or disconnection of an energizing element (for example, a heater element for a thermal printer) disposed inside the liquid discharger. In such cases, there are no sufficient methods for solving these problems. Thus, usually, the head is replaced.

There are two types of known inkjet printers: 1) a serial printer in which the head prints while it moves back and forth in the direction orthogonal to the feeding direction of the printing paper and while the printing paper is sent in the direction perpendicular to the direction in which the head is moving; and 2) a line printer in which a head is formed along the entire width of the printing paper and in which printing is performed while the printing paper is sent in the feeding direction.

A line inkjet printer has a plurality of small head chips disposed in parallel so that the ends of each head chip are connected. Each head chip is processed by an appropriate signal so that the head chips record data in series along the entire width of the printing paper.

A serial inkjet printer employs an overlapping method for printing a gray scale.

In this method, the characteristics of the liquid dischargers are averaged by overlapping ink droplets (dots) many times in one pixel area. More specifically, dots are formed to fill the gaps between the previously formed dot row.

Even if some of the liquid dischargers malfunction to a certain degree or if there are liquid dischargers that cannot discharge any liquid, the effect of failure of these liquid dischargers can be minimized by overlapping the dots.

The head of the line inkjet printer does not move in the direction perpendicular to the feeding direction of the printing paper. Therefore, once an area has been recorded, it cannot be re-recorded by overlapping the dots.

When there is more than one failed discharger, a white line is generated because a row of pixels cannot be formed. This failure is prominent in photographs and graphics that require high quality.

For line inkjet printers, the tone can be increased by overlapping dots in the feeding direction of the printing paper. Overlapping of the dots, however, is only effective for increasing the tone and does not average the quality of the dischargers.

SUMMARY OF THE INVENTION

An object of the present invention is to compensate for the dischargers that have failed to discharge droplets by employing a technology for deflecting the trajectory of discharged ink droplets already disclosed by the inventors (for example, Japanese Unexamined Patent Application Publication Nos. 2002-161928, 2002-320861, and 2002-320862).

The present invention achieves the above-mentioned object by the following means.

The present invention comprises a liquid discharge apparatus including a plurality of heads having liquid dischargers with nozzles aligned in parallel in a predetermined direction, wherein a pixel composed of a predetermined number of dots is formed in a pixel area on a recording medium according to a liquid discharger signal. The liquid discharger is capable of deflecting the trajectories of the discharged droplets to a certain extent in the predetermined direction. At least two neighboring dischargers are capable of discharging droplets that land in the same pixel area. The liquid discharge apparatus includes a storing unit for storing information on the shut-off of the liquid discharger due to discharge failure. The liquid discharge apparatus also includes an alternative unit for discharging droplets for transferring at least a part of a liquid discharge signal sent to the liquid discharger shut-off according to the information stored in the storing unit to at least one other liquid discharger disposed in the vicinity of the shut-off liquid discharger. The alternative unit is also for controlling at least one of the other dischargers to discharge a droplet so that the droplet lands in the same position as the droplet that was supposed to be discharged by the shut-off discharger.

According to the present invention, the trajectories of the droplets discharged from the liquid dischargers can be deflected in a plurality of directions. At least two dischargers neighboring each other, e.g., two liquid dischargers disposed side by side in a predetermined direction, are capable of discharging droplets so that the droplets land in the same pixel area.

When there is a liquid discharger that is shut-off due to droplet discharge failure, this information is stored in the storing unit for storing information on the shut-off of the liquid discharger.

According to the stored information, at least a part of the discharge signal for the droplets the shut-off discharger was supposed to discharge is transferred to at least one other liquid discharger in the vicinity. The other liquid discharger alternatively discharges droplets so that the droplets land in a position at which the droplets would have had landed if they were discharged by the shut-off discharger.

The operation of the liquid discharger that failed to discharge droplets is compensated for by discharging the droplets by other liquid dischargers.

DESCRIPTION OF THE PREFERRED EMBODIMENTS

Figure 1:
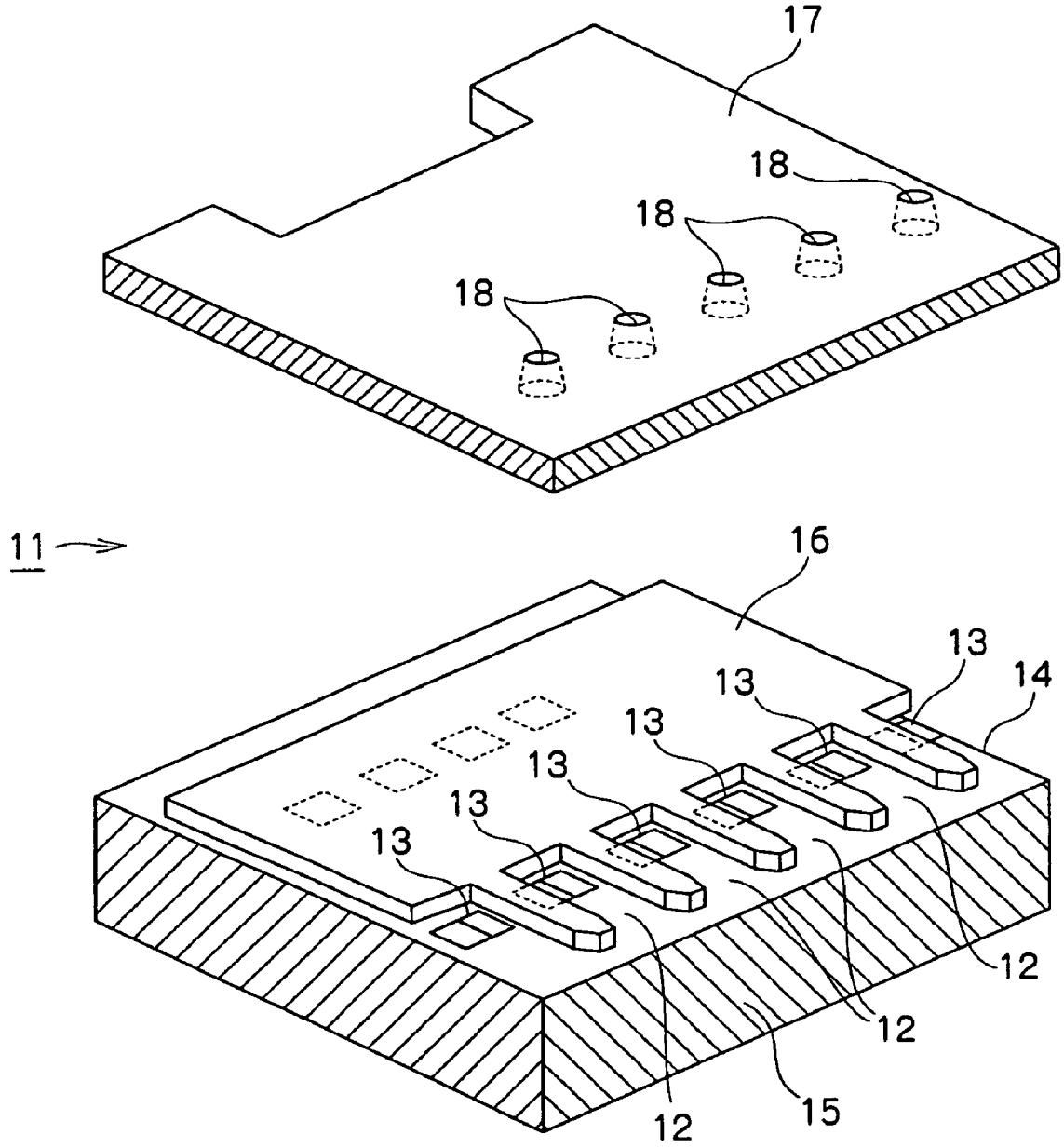
FIG. 1 is an exploded perspective view of an inkjet printer head having liquid dischargers according to the present invention.

In the following, embodiments of the present invention are described with reference to the drawings. In this specification, the term 'droplet' refers to a minute amount (for example, several picoliters) of liquid (i.e., ink in the embodiments) discharged from a nozzle 18 of a liquid discharger described in the following. The term 'dot' refers to a droplet that has landed on a recording medium such as printing paper. The term 'pixel' refers to the minimum unit of an image. The term 'pixel area' refers to the area that forms a pixel.

In one pixel area, a predetermined number (i.e., none, one or more) of droplets land to form three types of pixels: a pixel formed of no dots (tone 1); a pixel formed of one dot (tone 2); or a pixel formed of a plurality of dots (tone 3 or more). The pixels are aligned on a recording medium to form an image.

The dot(s) that corresponds to a pixel does not always land inside the pixel area and may land outside the pixel area.

In the following, an embodiment of a liquid discharge apparatus according to the present invention is described.

The liquid discharge apparatus according to this embodiment has a line head for discharging droplets.

The line head is formed by aligning a plurality of liquid dischargers in parallel across the width of the recording medium (or in the direction perpendicular to the feeding direction of the recording medium).

The liquid discharger includes:

1) liquid chambers containing the liquid for discharging droplets (which correspond to ink chambers 12 indicated in the following);

2) energizing elements for applying energy to the liquid contained in the liquid chamber (which correspond to heat generation resistive elements 13 indicated in the following); and 3) a nozzle sheet having nozzles (discharge outlets) for discharging the liquid contained in each liquid chamber by controlling each energizing element.

The liquid discharger deflects the trajectory of each droplet discharged from a nozzle in various amplitudes along the direction the liquid dischargers are aligned. For example, the energizing element is disposed on at least a part of a surface of the liquid chamber. The energizing element controls the energy distribution by, for example, causing a difference in the energy applied to two areas controlling the energy distribution disposed above the energizing element or by causing a difference in the energy distribution between the two areas disposed above the energizing element. The liquid discharge apparatus according to the present invention, however, is not limited to this embodiment.

FIG. 1 is an exploded perspective view of a head 11 of an inkjet printer (hereafter referred to as a 'printer') including a liquid discharge apparatus according to the present invention. FIG. 1 is an exploded view of a nozzle sheet 17 disposed on a barrier layer 16.

A substrate 14 on a head 11 includes a silicon semiconductor substrate 15 and heat generation resistive elements 13 formed by deposition on one surface of the semiconductor substrate 15. The heat generation resistive elements 13 are electrically connected to an external circuit via a conductor (not shown in the drawing) formed on the semiconductor substrate 15.

The barrier layer 16 is, for example, formed by stacking a photosensitive cyclic rubber resist or a photo-curable dry film resist on the entire surface provided with the heat generation resistive elements 13 of the semiconductor substrate 15 and then by removing unnecessary portions by a photolithography process.

The nozzle sheet 17 includes a plurality of nozzles 18 and is formed by, for example, electrotyping with nickel. The nozzle sheet 17 is disposed on the barrier layer 16 so that the locations of the nozzles 18 are aligned with the opposing heat generation resistive elements 13.

The ink chambers 12 are defined by the substrate 14, the barrier layer 16, and the nozzle sheet 17 surrounding the heat generation resistive elements 13. More specifically, as shown in the drawing, the substrate 14 functions as the bottom walls of the ink chambers 12, the barrier layer 16 functions as the sidewalls of the ink chambers 12, and the nozzle sheet 17 functions as the upper walls of the ink chambers 12. In this way, the ink chambers 12 have openings in the front right surface shown in FIG. 1. These openings and an ink channel (not shown in the drawing) communicate with each other.

One of the heads 11 described above normally has ink chambers 12 and heat generation resistive elements 13, which are disposed in the respective ink chambers 12, on the order of 100 units. A controller of the printer commands each of the heat generation resistive elements 13 independently. In this way, ink contained in the ink chamber 12 corresponding to the controlled heat generation resistive elements 13 is discharged from the nozzles 18 opposing the ink chambers 12.

More specifically, the ink chambers 12 are filled with ink sent from an ink tank (not shown in the drawing) connected to the head 11. By applying a pulse current to the heat generation resistive element 13 for a short time, e.g., for 1 to 3 μsec, the heat generation resistive element 13 is rapidly heated. As a result, a gaseous ink bubble is formed where the ink contacts the heat generation resistive element 13. When the ink bubble expands, a predetermined amount of ink is pushed out (or in other words, the ink boils). In this way, the same amount of ink as the ink pushed out from above the nozzle 18 is discharged from the nozzle 18 as an ink droplet. The droplet lands on printing paper to form a dot.

Figure 2:
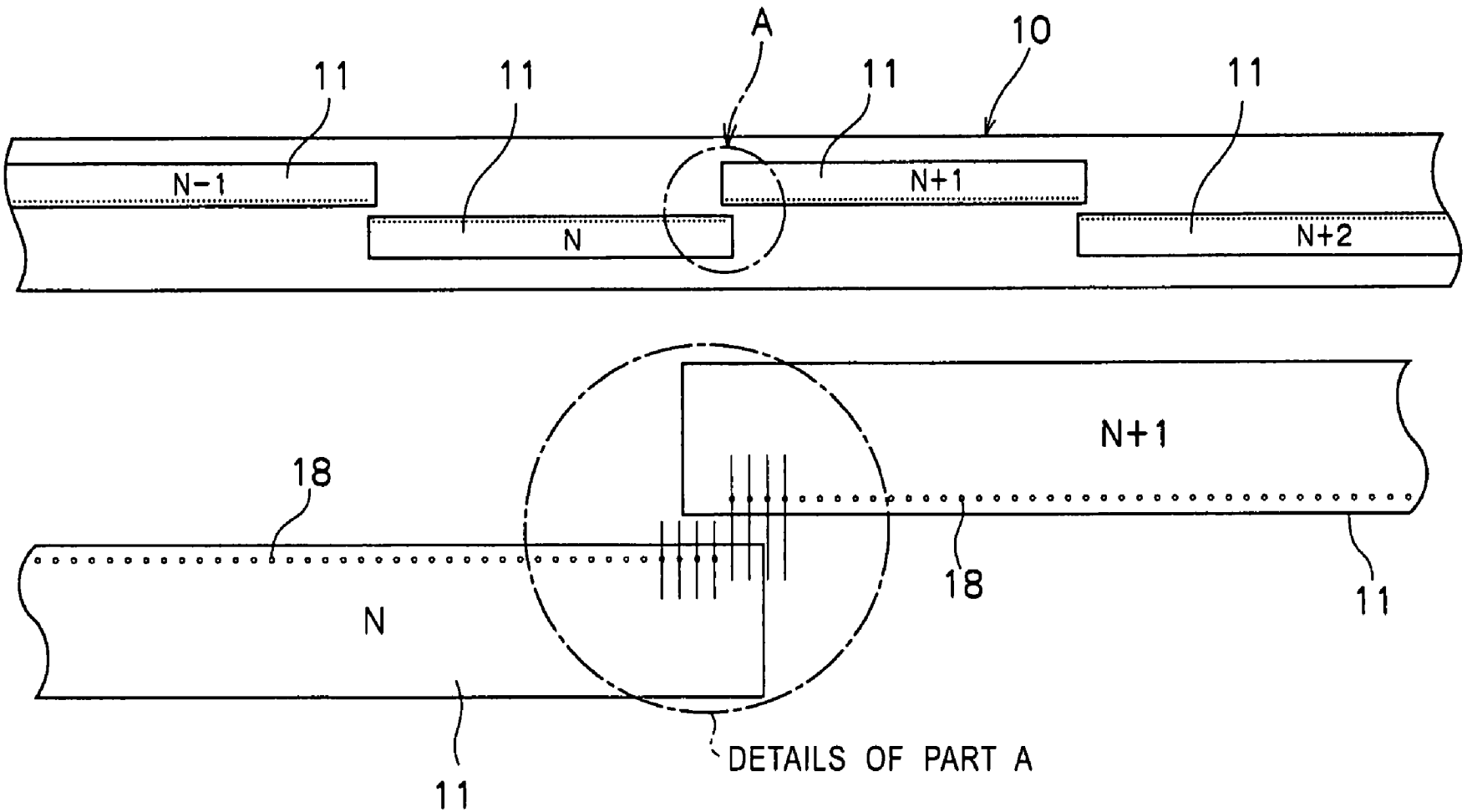
FIG. 2 is a plan view of a line head according to the embodiment of the present invention.

In this embodiment, the line head is formed by aligning a plurality of heads 11 across the width of a recording medium. FIG. 2 is a plan view illustrating an embodiment of a line head 10. FIG. 2 depicts four heads 11 (N−1, N, N+1, and N+2). To form the line head 10, the heads 11 without the nozzle sheets 17, which are known as head chips, are aligned in series. Then, one nozzle sheet 17 with nozzles 18 formed in positions corresponding to the liquid dischargers of each head chip is attached to the upper part of the head chips.

As shown in the detailed drawing of part A included in FIG. 2, the heads 11 are aligned so that the pitches between the nozzles on each side of the neighboring heads 11 are equal. In other words, the distance between one of the nozzles 18 at the right of the Nth head 11 and one of the nozzles 18 at the left of the N+1th head 11 is equal to the pitch between the nozzles 18.

By disposing a plurality of line heads 10 in parallel with predetermined intervals and by supplying different colored ink for each line head 10, a color line head can be constituted.

The liquid discharger of this embodiment is described in more detail in the following.

Figure 3A:
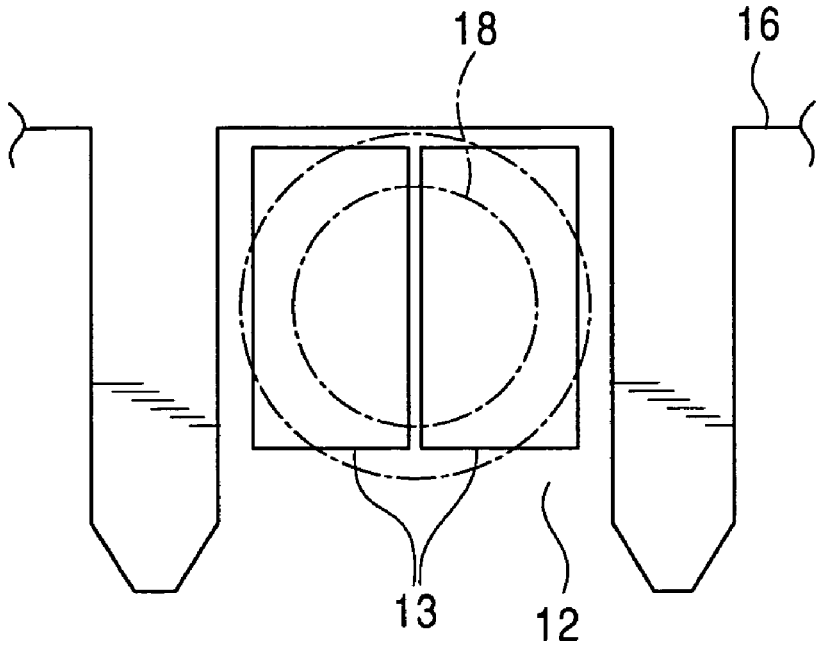
FIG. 3 is a plan view and a sideward cross-sectional view illustrating the liquid discharger of the head of FIG. 1 in detail.
Figure 3B:
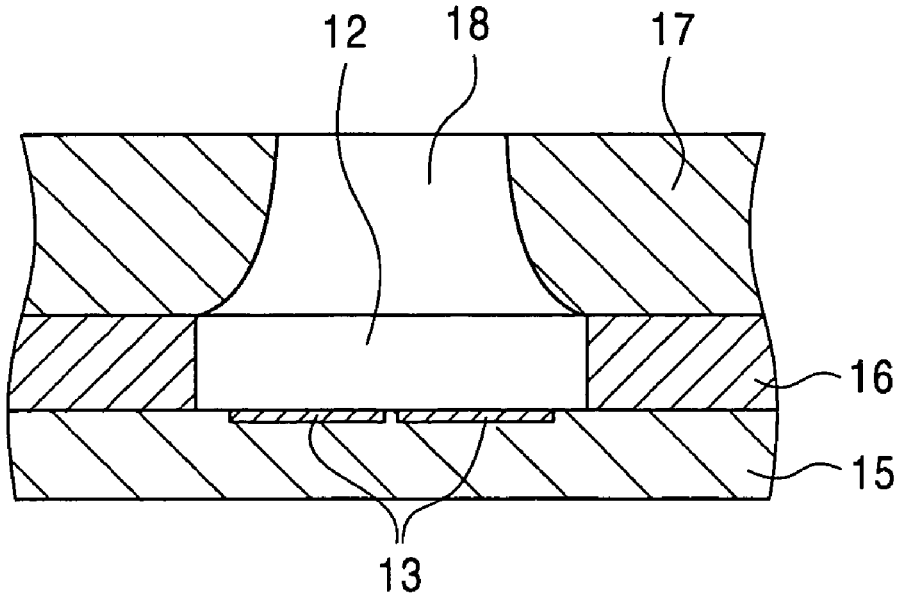

FIG. 3 is a plan view and a sideward cross-sectional view showing one of the liquid dischargers of one of the heads 11 in more detail. The chained line in the plan view of FIG. 3 indicates one of the nozzles 18.

As shown in FIG. 3, one heat generation resistive element 13 is included inside each ink chamber 12 of each head 11 according to this embodiment. The heat generation resistive element 13 is composed of two parts arranged in parallel. The two parts of the heat generation resistive element 13 are arranged in the same direction as the axis of the nozzle 18 (the left and right in FIG. 3).

When the heat generation resistive element 13 having two parts is contained in one of the ink chambers 12 and when each part is set to have the same bubble generation time, i.e., the time required for one of the parts of the heat generation resistive element 13 to reach the ink boiling temperature, the ink above both parts boils simultaneously and an ink droplet is discharged along the direction of the central axis of the nozzle 18.

On the contrary, when there is a difference in the bubble generation time of the two parts of the heat generation resistive element 13, the ink does not boil simultaneously above both parts. Thus, the trajectory of the ink droplet is shifted from the central axis of the nozzle 18. As a result, the trajectory of the ink droplet is deflected. In this way, the ink droplet lands in a position shifted from the landing position of an ink droplet discharged without a bubble generation time difference.

Figure 4:
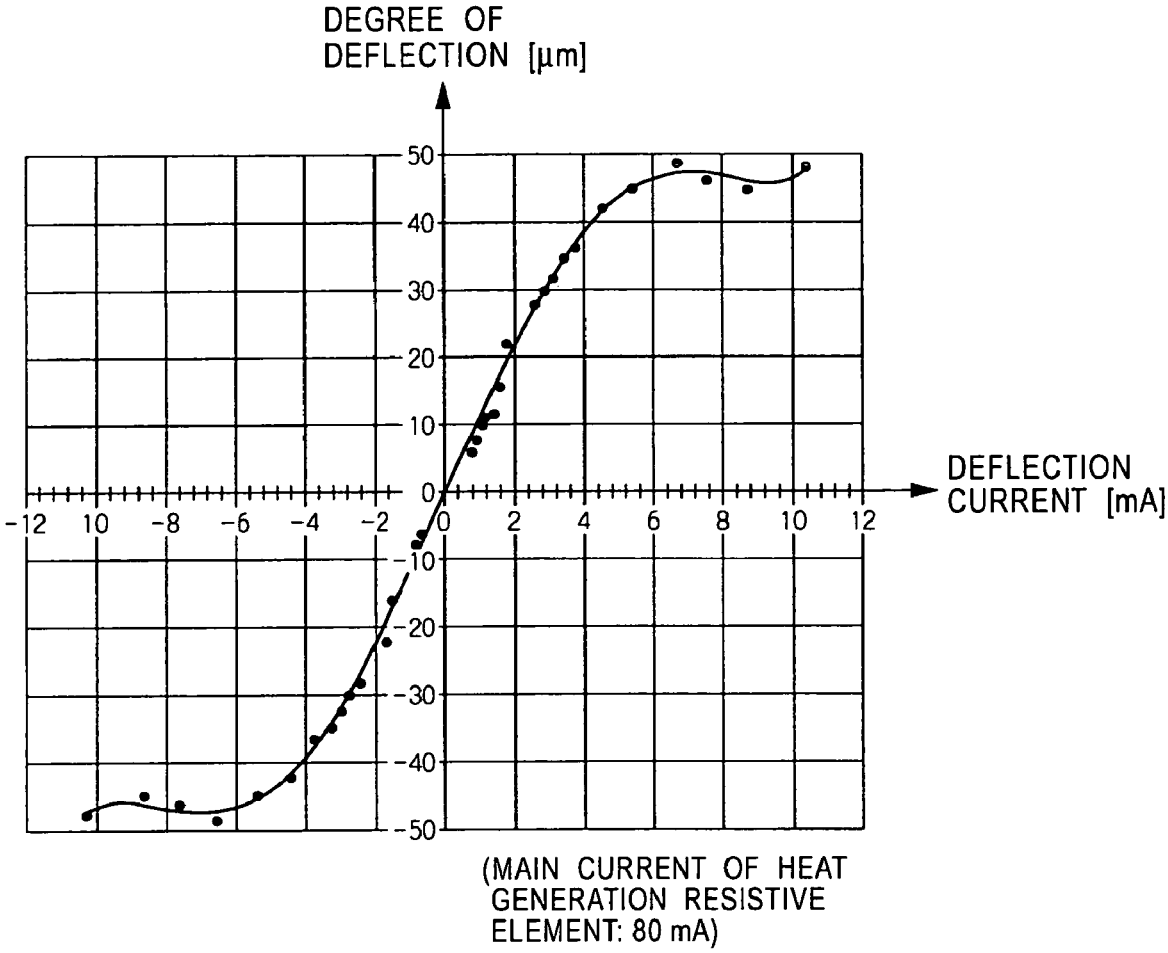
FIG. 4 is observed data showing the relationship of the difference in the current between two parts of a heat generation resistive element versus the amplitude of deflection.

FIG. 4 shows the observed measurements for generating a time lag in the ink bubble generation in each of the two parts of the heat generation resistive element 13. The horizontal axis represents deflection current, which is one-half of the difference of the current between the two parts of one of the heat generation resistive elements 13. The vertical axis represents the amplitude of deflection in the droplet-landing position, which is the amount of deflection from the intersecting point of the surface of the recording medium and the central axis of the nozzle extended to the ink droplet landing surface of the recording medium. In FIG. 4, the main current of one of the heat generation resistive elements 13 is 80 mA. The deflection current is applied on one of the parts of the heat generation resistive elements 13 to deflect the trajectory of the ink droplet. The distance from the tip of one of the nozzles 18 to the landing position of the ink droplet is 2 mm.

When the current applied to the two parts of the heat generation resistive element 13 is changed by making the deflection current greater, the time lag of the bubble generation between the two parts becomes greater. According to the time lag, the amplitude of deflection becomes greater. As a result, the ink droplet will land in a deflected position compared to when the ink is discharged without a difference in the bubble generation time between the two parts.

In this embodiment, a difference in the energy generation distribution of the lower surface inside one of the ink chambers 12 was created by composing the heat generation resistive element 13 of two parts. The present invention, however, is not limited to this embodiment. For example, a heat generation resistive element 13 composed of a single part may be disposed on the lower surface of the ink chamber 12. The heat generation resistive element 13 may include two different areas that generate different amounts of heat energy. In this way, the lower surface of the ink chamber 12 will include two areas each having a different energy generation distribution. As a result, a time lag of the bubble generation between the two areas in the ink chamber 12 is created and the trajectory of the ink droplet is deflected.

By employing the structure described in the above, according to the present invention, at least two neighboring liquid dischargers are capable of discharging droplets that land at the same pixel area. In particular, when P is the alignment pitch in the alignment direction of the liquid dischargers, the landing position of the droplets discharged from each liquid discharger can be determined by the formula below:

$$\pm(\tfrac{1}{2}\times P)\times N \text{ (where N is a positive integer)} \qquad \text{(Formula 1).}$$

The landing position is a position relative to the center of the liquid discharger and in alignment with the nozzles 18.

Figure 5:
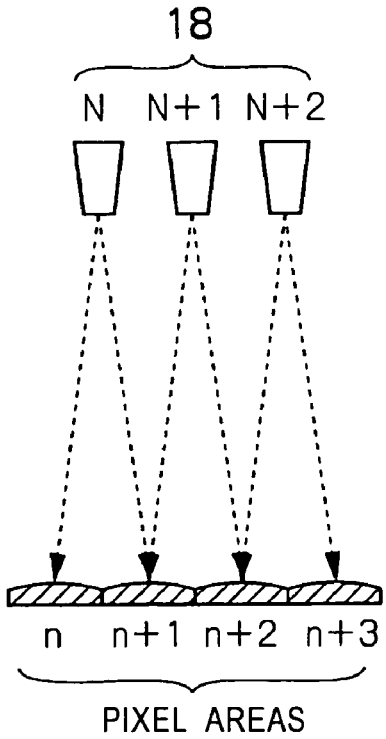
FIG. 5 is a front view of the landing positions of the ink droplets discharged from nozzles of a liquid discharger aligned in parallel.

FIG. 5 is a front view showing the relationship between aligned nozzles 18 of a liquid discharger and the landing position of an ink droplet (the location where a dot is formed).

In FIG. 5, ink droplets discharged from two neighboring liquid dischargers of nozzles 18 land in the same pixel area.

In FIG. 5, the nozzle N can discharge an ink droplet so that the ink droplet lands in the pixel area n or n+1. The intersecting point of the central axis of the nozzle N extended to the surface of the recording medium (i.e., the landing position of the ink droplet) and the surface of the recording medium matches the middle point between the pixel area n and the pixel area n+1.

Furthermore, the nozzle N+1 is capable of discharging a droplet so that it lands in the pixel area n+1 or n+2.

In this way, a dot can be formed in the pixel area n+1 by discharging an ink droplet from the nozzle N by deflecting the trajectory of the ink droplet to the right in FIG. 5 or by discharging an ink droplet from the nozzle N+1 by deflecting the trajectory of the ink droplet to the left in FIG. 5.

Other nozzles 18 and pixel areas also have similar relationships.

In FIG. 5, the landing positions of the droplets discharged from each liquid discharger can be determined by the formula below:

$$\pm(/\mathbf{1};\mathbf{2}\times P)\times 1.$$

The landing position is a position relative to the center of the liquid discharger and in alignment with the nozzles 18. In other words, this is the same as Formula 1 wherein N=1.

For example, for 600 dpi, the nozzle pitch is 42.33 μm. Therefore, the amount of deflection at the landing position is 21.15 μm on each side.

Figure 6:
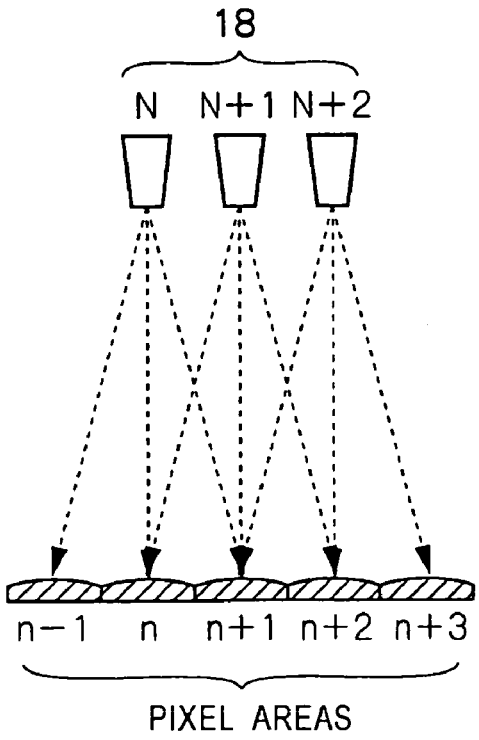
FIG. 6 is another front view showing the relationship between the nozzles of the liquid dischargers aligned in parallel and the landing position of an ink droplet.

FIG. 6 illustrates a different embodiment of the present invention compared to FIG. 5. In FIG. 6, ink droplets discharged from three neighboring liquid dischargers of nozzles 18 land in the same pixel area.

In FIG. 6, the three neighboring nozzles of the liquid dischargers are nozzles N, N+1, and N+2. An ink droplet discharged perpendicularly towards the surface of the recording medium (i.e., the same direction to the central axis of the nozzle N) from the nozzle N lands in a pixel area n. The pixel areas on the left and right sides of the pixel area n are pixel areas n−1 and n+1.

An ink droplet can be discharged in a direction perpendicular to the surface of the recording medium from the nozzle N+1 so that the ink droplet lands in the pixel area n+1.

The trajectory of an ink droplet discharged from the nozzle N can be deflected to the right in FIG. 6 so that the ink droplet lands in the pixel area n+1.

Moreover, the trajectory of an ink droplet discharged from the nozzle N+2 can be deflected to the left in FIG. 6 so that the ink droplet lands in the pixel area n+1.

Other nozzles 18 and pixel areas have similar relationships.

In FIG. 6, the landing position of the droplets discharged from each liquid discharger can be determined by the formula below:

$$\pm(/\mathbf{1};\mathbf{2}\times P)\times 2.$$

The landing position is a position relative to the center of the liquid discharger and in alignment with the nozzles 18. In other words, this is the same as Formula 1 wherein N=2.

In the present invention, droplet discharge signals for forming a dot row in the feeding direction of the printing paper (the direction the head 11 and the printing paper move relative to each other) are sent one after another to at least two liquid dischargers capable of discharging a droplet in the droplet-landing position that corresponds to the discharge signal. Then by discharging a droplet in a predetermined direction according to the received discharge signal from at least two liquid dischargers, a dot row is formed.

Figure 7:
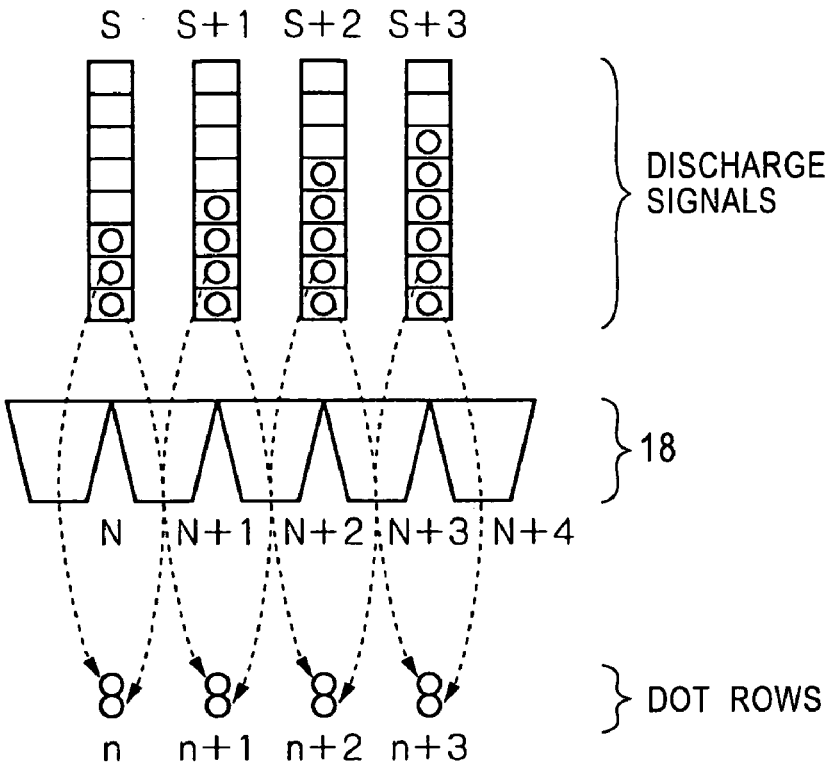
FIG. 7 illustrates a controlling method for forming a dot row by discharging ink droplets in a predetermined direction according to the distributed discharge signal (FIG. 7 corresponding to FIG. 5)

FIG. 7 illustrates this method and is an embodiment of a liquid discharger capable of deflecting the trajectories of ink droplets. In other words, this embodiment corresponds to Formula 1 wherein N=1.

In FIG. 7, the nozzles 18 of each liquid discharger are referred to as nozzles N, N+1, N+2, . . . in sequence. The dot rows disposed right under each nozzle N, N+1, N+2, . . . are each referred to as dot rows n, n+1, n+2, . . . , respectively. The discharge signals that correspond to the dot rows n, n+1, n+2, . . . are referred to as discharge signals S, S+1, S+2, . . . , respectively.

In FIG. 7, the discharge signal corresponding to each dot row is inputted to form dot rows that each make up one pixel. The discharge signal is a signal row composed of signal commands (which are indicated by circles disposed inside the discharge signal depicted in FIG. 7) for each dot of a dot row.

In FIG. 7, the blocks (slots) indicating the discharge signal represent the time sequence of the discharge signal. At a timing indicated by the circles (i.e., discharge signals) located inside the blocks, the ink droplets are discharged from the nozzles 18 of the liquid dischargers. The pitch of the blocks indicates the discharge cycle of the nozzles 18 of each liquid discharger. In this embodiment, 64 liquid dischargers form one group and are controlled uniformly. The pitch of the discharge signal block (the amount of time each block represents) is 1.5×64=96 μs. The circles inside the blocks represent a discharge signal commanding the logic output to be "1" for 1.5 μs. During the 1.5 μs, a current is applied to the heat generation resistive element 13.

In this case, for example, each discharge command of the discharge signal S is alternately distributed to nozzles (i.e., liquid dischargers) N and N+1. More specifically, the first discharge command of the discharge signal S (i.e., the circle representing the discharge command located inside the lowest block in FIG. 7) is sent to the nozzle N+1. Then the trajectory of an ink droplet discharged from the nozzle N+1 is deflected to the left in the drawing and lands on the dot row n. The next discharge command is sent to the nozzle N. Then the trajectory of an ink droplet discharged from the nozzle N is discharged to the right in the drawing and lands on the dot row n.

In this way, the single discharge signal S alternately sends a discharge command to the nozzles N and N+1 so that the ink droplets are discharged in a predetermined direction. Consequently, a dot row corresponding to the discharge signal is formed.

In this way, each discharge command of a single discharge signal is distributed, one after another, to a plurality of liquid dischargers, and then ink droplets are discharged in a predetermined direction. Finally, a dot row corresponding to the discharge signal is formed.

Figure 8:
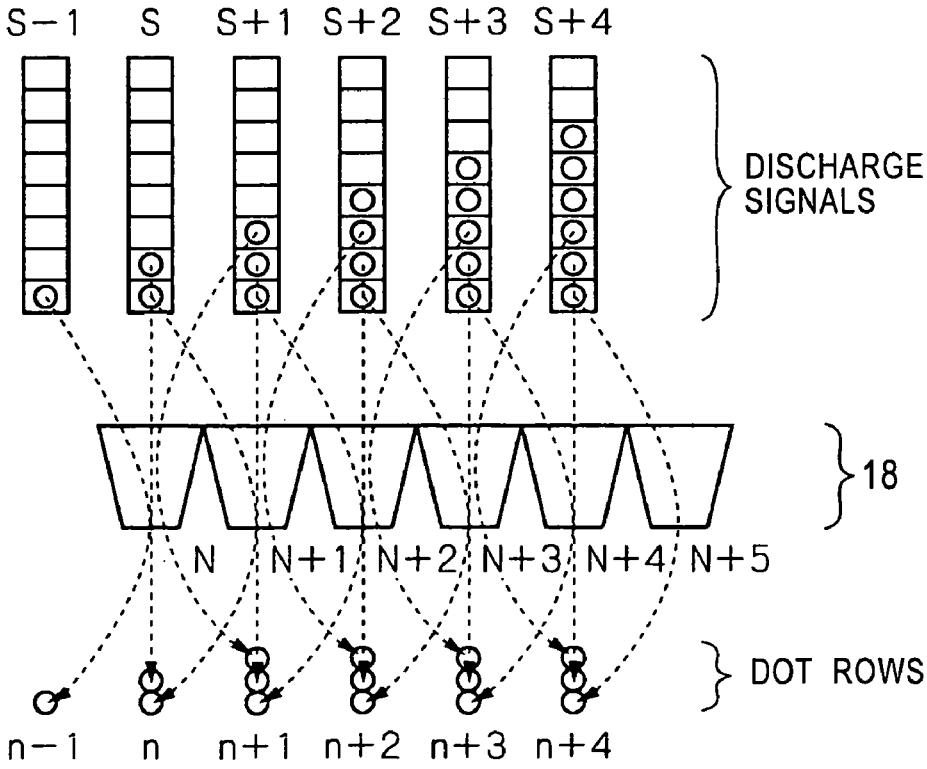
FIG. 8 illustrates a controlling method for forming a dot row by discharging droplets from a plurality of dischargers in a predetermined direction according to a distributed discharge signal (FIG. 8 corresponding to FIG. 6)

FIG. 8 illustrates a control method similar to FIG. 7 and is an embodiment according to the present invention of a liquid discharger capable of deflecting the trajectories of ink droplets as shown in FIG. 6. In other words, this embodiment corresponds to Formula 1 wherein N=2.

In FIG. 8, the first discharge command of the discharge signal S+1 (i.e., the circle representing the discharge command located inside the lowest block in FIG. 8) is sent to the nozzle N+2. Then the trajectory of an ink droplet discharged from the nozzle N+2 is deflected to the left in the drawing so that the ink droplet lands on the dot row n+1. The next discharge command is sent to the nozzle N+1. Then an ink droplet is discharged from the nozzle N+1 downwards without deflection and lands on the dot row n+1. The subsequent discharge command is sent to the nozzle N. Then the trajectory of an ink droplet discharged from the nozzle N is deflected to the right in the drawing so that the ink droplet lands on the dot row n+1.

The distribution of the discharge commands described above is an embodiment. Various other embodiments are possible for the distribution method of each distribution command of the distribution signal. For example, the first and second discharge commands can be supplied to the same liquid discharger and the third and fourth discharge commands can be supplied to another liquid discharger. Similarly, the subsequent discharge commands can be distributed to other liquid dischargers.

Figure 9:
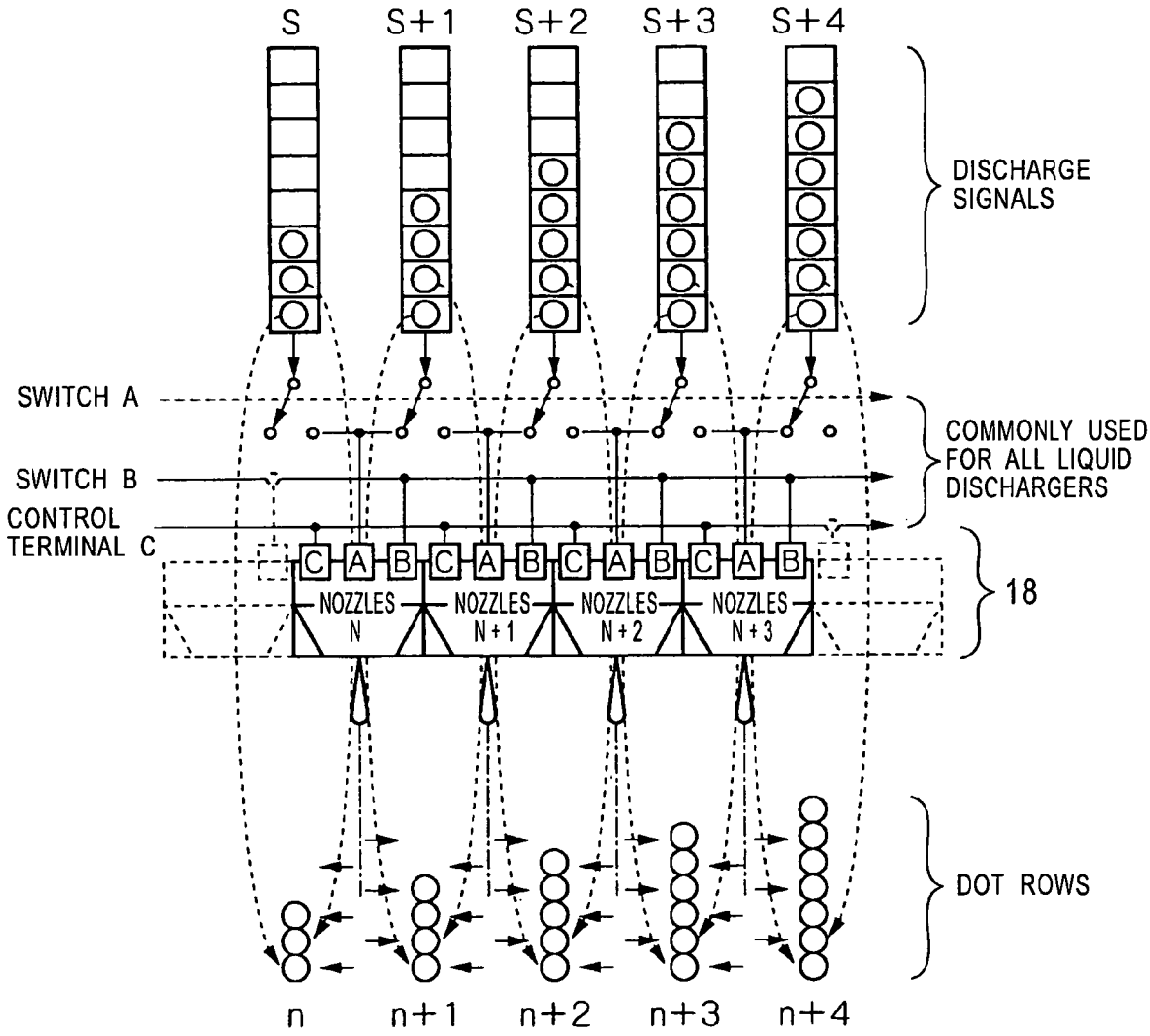
FIG. 9 illustrates the control of the selection of a liquid discharger, the direction of deflection, and the amplitude of the deflection for the embodiment illustrated in FIG. 7.

FIG. 9 illustrates the selection of the liquid discharger, the deflection direction, and the controlling of the deflection amplitude of the embodiment illustrated in FIG. 7.

The head 11 with a plurality of liquid dischargers aligned in parallel has switches A and B, which uniformly control all liquid discharger circuits, and a control terminal C. In other words, as described below, all liquid discharger circuits share the signal for selecting a liquid discharger (i.e., the signal for the switch A) and the signal for changing the trajectories of the ink droplets (i.e., the signal for the switch B).

The switch A is for selecting a liquid discharger and is used to determine to which liquid discharger to input a discharge command of a discharge signal. For example, by switching the switch A, the trajectories of the ink droplets discharged from all liquid dischargers can be switched to the same direction simultaneously. More specifically, when the switch A is set as shown in FIG. 9, the discharge signal S+1 is sent to the nozzle N.

The switch B is for switching the deflection of the trajectories of the ink droplets and is used to switch the deflection of the trajectories of the ink droplets leftward or rightward in the drawing. The switch B simultaneously switches the deflection of the trajectories of the ink droplets discharged from all liquid dischargers to the same direction.

The switches A and B are operated in conjunction with each other. In other words, the signal for the switch B is synchronized with the signal for the switch A. For example, when the switch A is set as shown in FIG. 9, the discharge command of the discharge signal S+1 is sent to the nozzle N. At the same time, the switch B controls the liquid discharger so that the trajectory of an ink droplet is deflected to the right in the drawing. In this way, the trajectory of the ink droplet from the nozzle N is deflected to the right in the drawing to form the dot row n+1.

The control terminal C is a terminal for analogly controlling the deflection amplitude within the range of characteristics indicated in FIG. 4. When an appropriate voltage is applied to the control terminal C, a predetermined current is applied to the heat generation resistive elements 13. In this way, by controlling the current (i.e., deflection current) applied to the heat generation resistive elements 13 by changing the voltage, the amplitude of deflection of the trajectory of a discharged droplet (i.e., the landing position of the droplet) can be controlled.

Next, the control of an alternative discharge (i.e., alternative unit for discharging droplets) operated when a liquid discharger fails to discharge a droplet is described.

Figure 10:
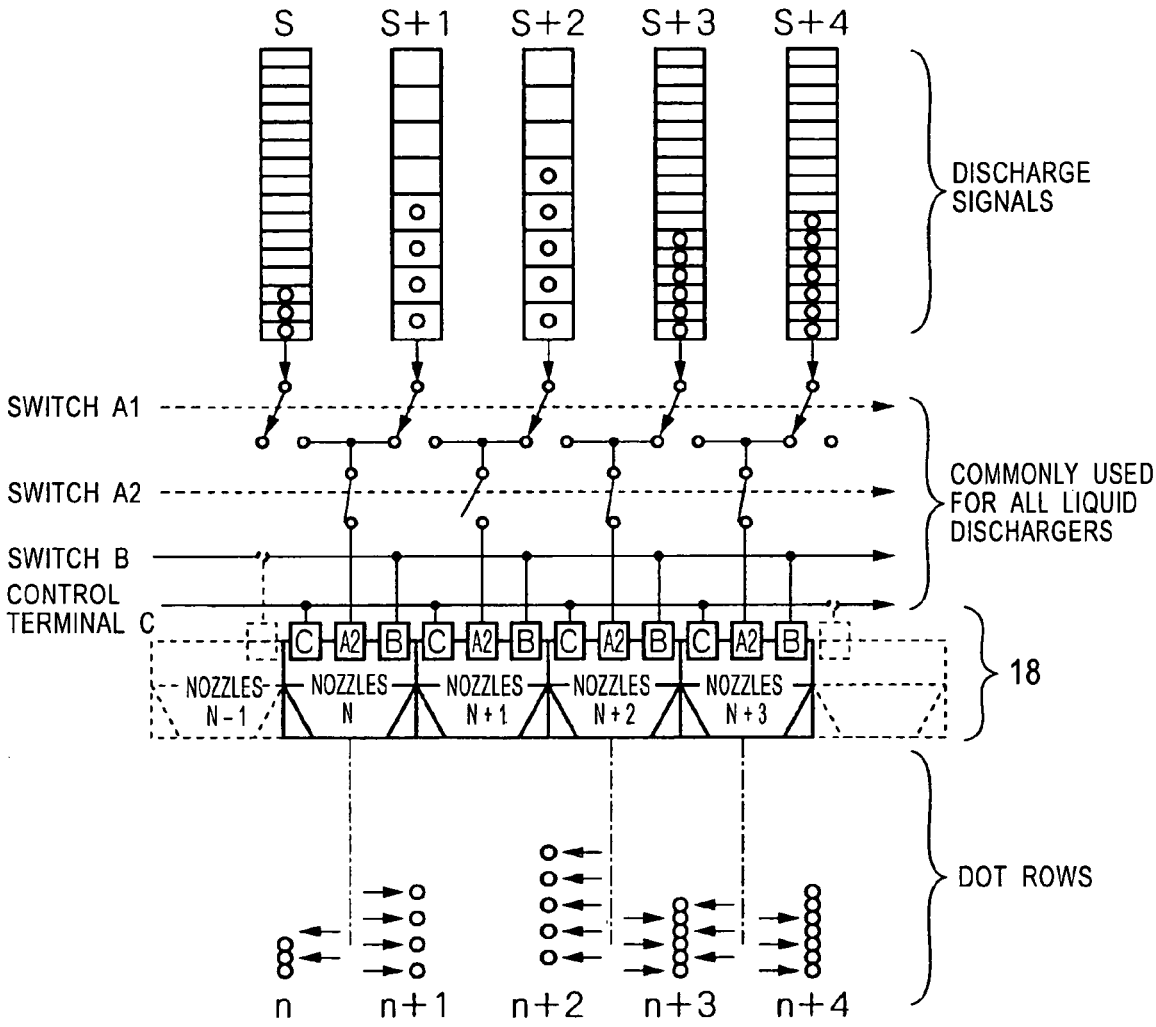
FIG. 10 illustrates the system concept for control of the alternative discharge shown in FIG. 9.

FIG. 10 illustrates the system concept for control of the alternative discharge shown in FIG. 9.

In FIG. 10, a switch Al is the same as the switch A in FIG. 9. FIG. 10, furthermore, includes a switch A2 for setting each liquid discharger individually. When the switch A2 is turned on, similarly as described in FIG. 9, a discharge command of a discharge signal is sent to the liquid discharger. When the switch A2 is turned off, the discharge command of the discharge signal is not sent to the liquid discharger.

A switch B and a control terminal C illustrated in FIG. 10 are the same as those illustrated in FIG. 9.

The following are examples of methods for determining whether or not a liquid discharger should be shut-off due to discharge failure of ink droplets (failed dischargers include those that cannot or mostly cannot discharge ink droplets).

As a first method, an appropriate test pattern is printed. Then the printed test pattern is compared with a standard pattern. If the printed test pattern is not the same as the standard pattern, a liquid discharger has a failure. In this case, the failure is determined by visual examination.

The second method is a mechanical method wherein the discharged ink droplet is electrically charged. The charged ink droplet is dropped onto a particular insulated electrode. By observing the change in the electrical charge, it is determined whether or not the discharge of the ink droplet is normal.

As described above, there are various methods for determining failure in the discharge of an ink droplet.

For the normal (without failure) liquid discharger, the switch A2 is turned on, but for the failed liquid discharger, the switch A2 is turned off. FIG. 10 illustrates an embodiment wherein the switch A2 that corresponds to the nozzle N+1 is turned off (the switches A2 corresponding to nozzles except for N+1 are turned on).

As a particular circuit, an AND gate is included. The AND gate has a first input terminal which is set to "1" during the input of a discharge command (i.e., for 1.5 μs) and which is set to "0" during other times, and a second terminal which is set to "1" when the switch A2 is turned on and is set to "0" when the switch A2 is turned off. In this way, when the switch A2 is turned off (i.e., when there is a discharge failure), a discharge command is not sent to the liquid discharger.

Information related to the liquid dischargers that are to be shut-off because of discharge failure of ink droplets (i.e., information such as the number of failed liquid dischargers) can be stored in memory (i.e., a storing unit for storing information on the shut-off liquid dischargers). Then, for example, the information can be read out when power is supplied to control the switch A2.

Next, the controlling of the discharge signal is described.

When there is information on stopping the discharge or, in other words, when there is information on the shut-off of the liquid discharger stored in the storing unit, the discharge signal that the liquid discharger was supposed to process is sent to at least one other liquid discharger neighboring the shut-off liquid discharger. In particular, in this embodiment, the discharge signal is sent to the two liquid dischargers on both sides of the shut-off liquid discharger and these two liquid dischargers are controlled to alternatively discharge ink droplets. In such a case, the discharge signal is sent to the alternative liquid dischargers while those liquid dischargers are not discharging ink droplets.

In FIG. 10, the nozzle of the liquid discharger that is shut-off is the nozzle N+1. The signals this liquid discharger was supposed to process were the discharge signals S+1 and S+2. For the discharge signal S+1, the nozzle N is controlled to discharge ink droplets to form the dot row n+1 corresponding to the discharge signal S+1. For the discharge signal S+2, the nozzle N+2 is controlled to discharge ink droplets to form the dot row n+2 corresponding to the discharge signal S+2.

In this embodiment, the generation of the discharge signals for discharging ink droplets is controlled so that a discharge signal in a normal mode and a compensation mode are generated. The normal mode does not involve the shut-off liquid discharger, whereas the compensation mode involves the shut-off liquid discharger and sends the discharge signal to the two liquid dischargers on both sides of the shut-off liquid discharger.

In FIG. 10, discharge signals S, S+3, and S+4 do not involve the shut-off liquid discharger (i.e., the nozzle N+1). In other words, since the discharge signals S, S+3, and S+4 are not sent to the shut-off liquid discharger, normal mode discharge signals are generated and sent to predetermined liquid dischargers.

On the other hand, the discharge signals S+1 and S+2 involve the shut-off liquid discharger (i.e., the nozzle N+1). In other words, the discharge signals S+1 and S+2 were supposed to be sent to the shut-off liquid discharger and, thus, a compensation mode discharge signal is generated.

The time length of the discharge commands of the compensation mode discharge signal is twice as long as the time length of the discharge command of the normal mode discharge signal.

In FIG. 10, each of the blocks representing a discharge command of the compensation mode discharge signals S+1 and S+2 are twice the length compared to the blocks of the other discharge signals.

For example, for the discharge signal S+1, the time length of the first discharge command (i.e., the circle representing the discharge command located inside the lowest block in FIG. 10) is twice as long as the length of the discharge command of the normal mode discharge signal.

The switch Al for selecting the liquid discharger is alternately switched between the nozzles N and N+1. Thus the discharge signal S+1 is sent to nozzles N and N+1, alternately. The switch A2 of the nozzle N is turned on (connected) and the switch A2 of the nozzle N+1 is turned off (unconnected). Therefore, even when the discharge commands of the discharge signal S+1 are inputted to the nozzle N+1, ink droplets are not discharged according to the discharge commands (i.e., the liquid discharger of the nozzle N+1 is not driven).

On the contrary, when discharge commands of the discharge signal S+1 are inputted to the nozzle N, ink droplets are discharged according to the discharge commands.

Since, as describe above, the time of the discharge commands of the discharge signal is twice as long as the time of the discharge command of the normal mode discharge signal, each discharge command of the discharge signal S+1 is inputted to both the nozzles N and N+1. In this way, ink droplets are not discharged from the nozzle N+1 according to the discharge commands of the discharge signal S+1, but ink droplets are discharged from the nozzle N according to the discharge commands of the discharge signal S+1. As a result, ink droplets are discharged from the nozzle N according to all discharge commands of the discharge signal S+1.

Thus, the nozzle N receives a portion of the discharge commands of the discharge signal S (the other portion is inputted to the nozzle N−1, as shown by the dotted line) and the entire discharge signal S+1.

When the discharge commands of the discharge signal S are sent to the nozzle N, the switch B controls the trajectory of the ink droplets so that the landing position of the ink droplets are deflected by ½ pitch from the central axis of the nozzle N to the left in the drawing. In this way, the ink droplets discharged from the nozzle N according to the discharge commands of the discharge signal S form the dots of the dot row n.

On the contrary, when the discharge commands of the discharge signal S+1 are inputted to the nozzle N, the switch B controls the trajectory of ink droplets so that the landing position of the ink droplets are deflected by ½ pitch from the central axis of the nozzle N to the right in the drawing. In this way, the ink droplets discharged from the nozzle N according to the discharge commands of the discharge signal S+1 form the dots of the dot row n.

Furthermore, as described in the above, the discharge commands of the discharge signal S+1 are sent to both the nozzles N and N+1. Since the switch A2 is turned off, ink droplets are not discharged from the nozzle N+1.

When there is a liquid discharger (nozzle 18) that does not discharge ink droplets, the discharge signal the failed discharger was supposed to process is sent to the liquid dischargers in the neighborhood of the failed liquid discharger by controlling the liquid dischargers as described above. Since the neighboring dischargers alternatively discharge ink droplets instead of the failed discharger, the performance of the head 11 is not affected by the failed discharger that cannot discharge ink droplets.

In FIG. 10, the total time length of a discharge signal in the normal mode is represented by 16 blocks. In the compensation mode, each block becomes twice the length compared to those in the normal mode. Thus the total time length of the discharge signal in a compensation mode is eight blocks.

When this is applied to a printer according to the present embodiment, the number of ink droplets absorbed by one pixel on the printing paper is about 5 to 6 droplets, taking into consideration the preservation of the image quality and the drying time (here, the average volume of one droplet is about 4.5 picoliters). If binary numbers, which can be efficiently processed, are used for processing the discharge signals, the time length of three bits equals eight blocks. Thus, the structure of this embodiment, as described above, takes into consideration the maximum number of discharge commands for one pixel and the processing of the discharge signal.

For example, when the maximum number of discharge commands is six per pixel, whereas there are eight available blocks, the maximum number of discharge commands for an alternative discharge is also six. Therefore, it takes 1.5 times more time to process the discharge signals in the compensation mode compared to the normal mode.

When the number of discharge commands is close to maximum (e.g., 5 or 6), the concentration of the ink droplets is close to maximum and the gamma characteristic is considerably moderated. For this reason, in the compensation mode, if, for example, up to four discharge commands are used for an alternative discharge, these commands can be processed within the normal signal processing system without any additional processing time. Thus, the printing speed is not reduced.

To generate discharge signals in the compensation mode, all discharge commands may be sent to alternative nozzles. However, if priority is given to maintaining the printing speed, only a part of the discharge commands may be sent to alternative nozzles. In the present invention, the discharge commands may be sent in either way.

It is also possible to select an 'image quality priority mode' in which all discharge commands are sent to alternative nozzles even if the printing speed is reduced, or a 'printing speed priority mode' in which only a part of the discharge commands are sent to alternative nozzles while the printing speed is maintained. Either one of the two modes can be selected or the modes can be alternated according to the content of the image.

When a liquid discharger alternatively discharges ink droplets, the printing speed can be reduced or the operation speed of the liquid discharger can be increased compared to the printing speed in the normal mode.

Since a certain amount of time is required for refilling the ink chamber 12 with ink after an ink droplet is discharged, it is difficult to increase the operation speed of the liquid discharger. For this reason, when alternative discharge is performed in the present invention and more time than in the normal mode is required for processing the discharge signal, the printing speed is reduced.

The ratio of the pixel formation cycle (time required for forming one pixel) when alternative discharge is not performed to the pixel formation cycle when alternative discharge is performed is Q, wherein $Q$=(formation cycle for new pixel/formation cycle for original pixel).

When the relative speed of the head 11 and the printing paper is reduced, the relative speed is controlled so that it equals 1/Q.

In this way, the size of the printed image and the aspect ratio of the image can be maintained constant while performing alternative discharge.

Figure 11:
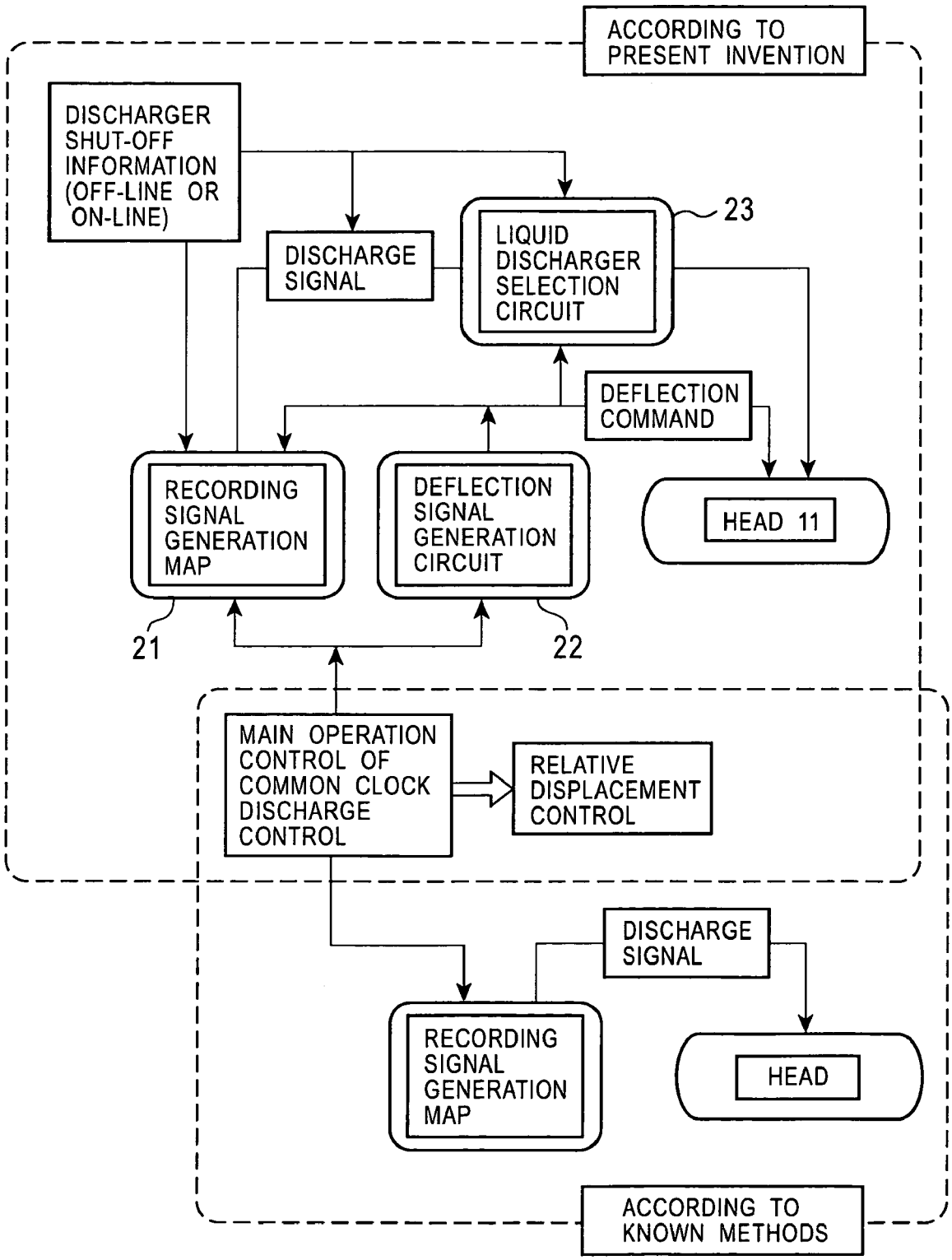
FIG. 11 illustrates an overview of the hardware control for when ink droplets are alternatively discharged.

FIG. 11 is an explanatory diagram of an overview of the hardware control for alternatively discharging an ink droplet. FIG. 11 also includes an overview of the control for known methods.

A known method shown in FIG. 11 is a method for merely sending a discharge signal to the head according to a recording signal generation map. On the other hand, in this embodiment, a discharge signal is sent to the head 11 via a recording signal generation map 21, a deflection signal generation circuit 22, and a liquid discharger selection circuit 23.

The recording signal generation map 21 is for generating a discharge signal (row), which is composed of discharge commands (which are actually digital data of either '1' or '0') disposed in each block (slot) for each pixel in a time series, as shown in FIG. 10, from printing data sent from an image processing circuit (after the processing such as error diffusion is completed). To generate the discharge signal, information on the shut-off discharger is read out from the abovementioned storing unit for storing information on a shut-off liquid discharger. Then a normal-mode or compensation-mode discharge signal is generated.

The deflection signal generation circuit 22 is a circuit for switching the amplitude of deflection, such as the switch B shown in FIG. 10, and for determining the amplitude of deflection by the control terminal C.

The liquid discharger selection circuit 23, shown in FIG. 10, is a circuit for selecting a liquid discharger corresponding to a discharge command by the switch A1 and for controlling dischargers by the switch A2 or, in other words, is for setting whether or not each discharger discharges ink droplets.

Then the discharge signal generated at the recording signal generation map 21 is sent to the head 11 via the liquid discharger selection circuit 23. The deflection command is sent to the head 11 from the deflection signal generation circuit 22.

The allocation of the discharge commands to each time slot (block) of the discharge signal is described below.

In FIG. 10 described in the above, discharge commands are disposed in the time slots of a discharge signal starting from the first time slot. In other words, the discharge commands are disposed one after another in the time slots of the discharge signal starting from the bottommost slot.

Figure 12:
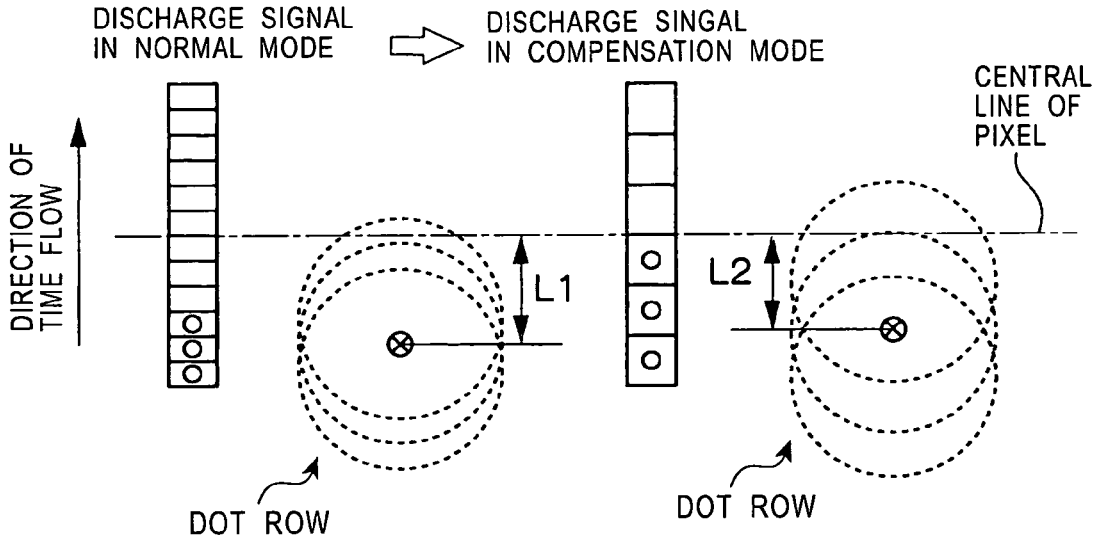
FIG. 12 illustrates the detailed positions of the dots of a dot row formed in the same pixel area according to a discharge signal.

The positioning of the dots forming a dot row in a pixel area according to a discharge signal is illustrated in detail in FIG. 12.

In FIG. 12, each discharge command is disposed one after another in the time slots (blocks) of a discharge signal. Therefore, if the number of discharge commands is small, the median point of the dot row is displaced (displacement is indicated by L1 and L2 in FIG. 12) from the central line of the pixel (indicated by a dashed line in the drawing).

Figure 13:
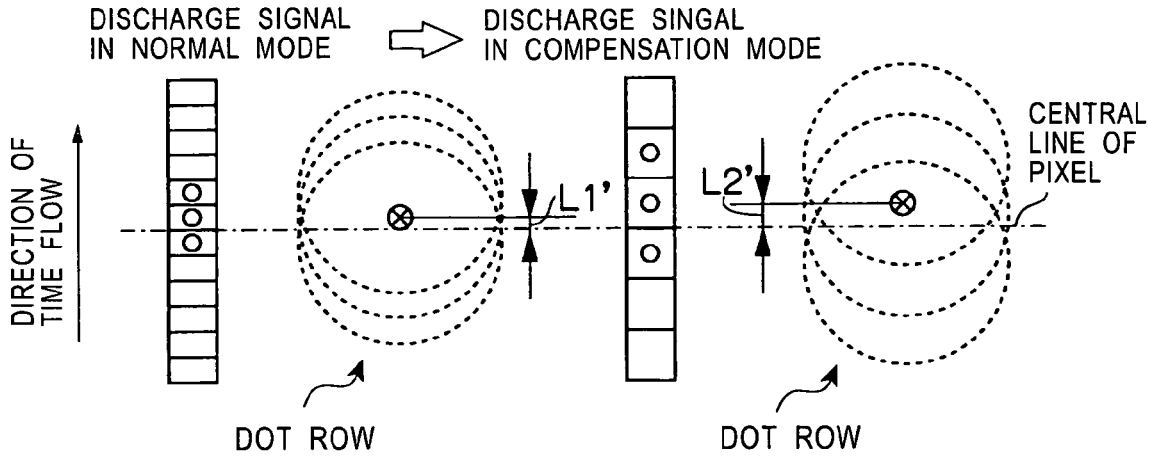
FIG. 13 illustrates, in comparison to FIG. 12, the control of the allocating discharge commands alternately on both sides of the central line of a pixel that is located in the center of the time slots.

In FIG. 13, a reference line (in this embodiment, this is the center of the time slots and is also the central line of the pixel) is taken near the center of the time slots in comparison with FIG. 12. FIG. 13 shows an embodiment wherein the discharge commands are allocated alternately on both sides of the reference line.

In this way, the median point of the dot row can be approximated to the central line of the pixel. In the embodiment illustrated in FIG. 13, the displacements are L1' and L2' which are each smaller than the displacement L1 and L2 in FIG. 12.

Figure 14:
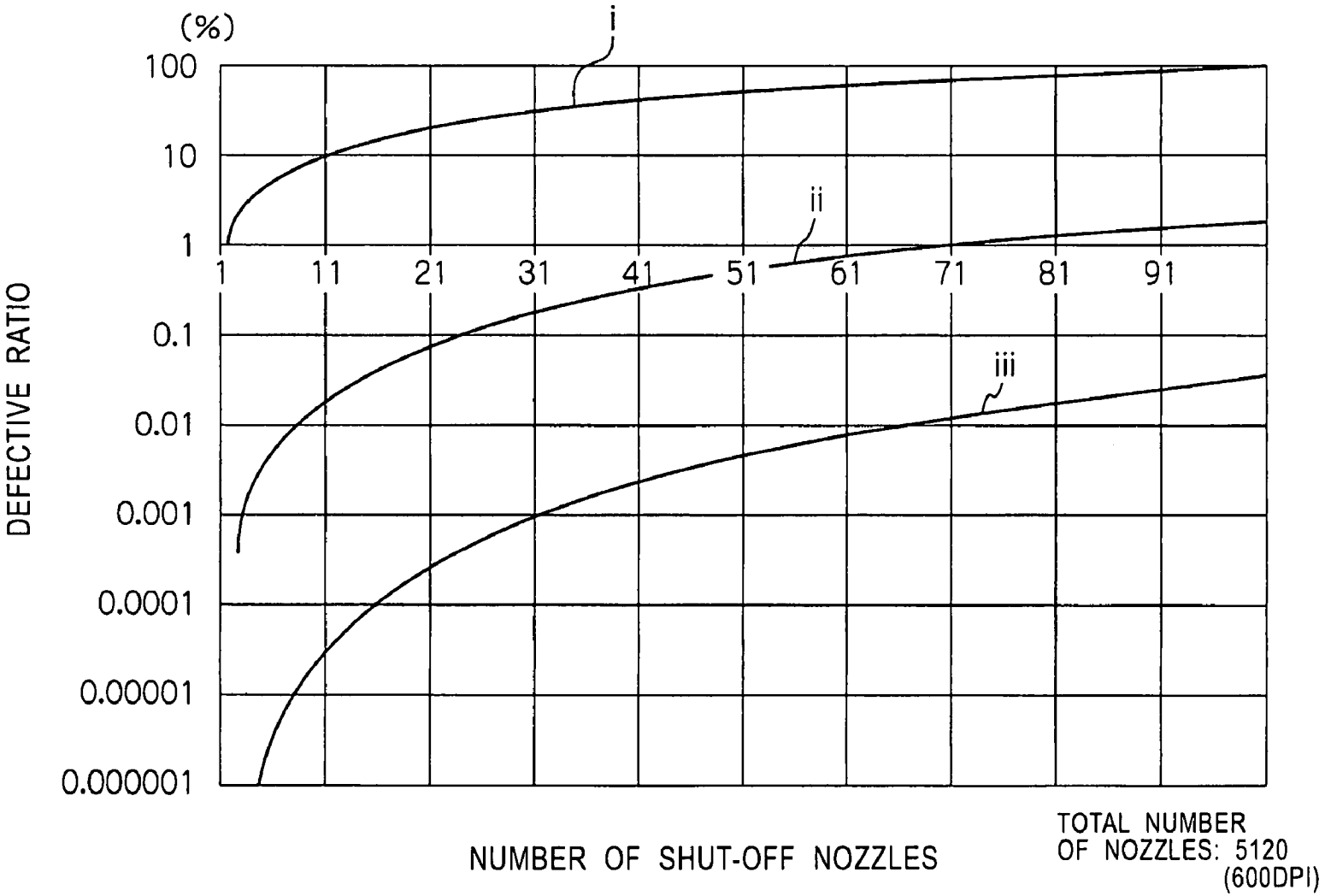
FIG. 14 is a graph indicating the fraction ratio of the line head when alternative discharge is performed.

FIG. 14 is a graph of the fraction ratio of the line head 10 when alternative discharge is performed as described in the above.

In FIG. 14, line i represents a case in which alternative discharge is not performed. Line ii represents a case, as shown in FIG. 5, in which ink droplets discharged from nozzles of two neighboring dischargers land in the same pixel area. Line iii represents a case, as shown in FIG. 6, in which ink droplets discharged from nozzles of three neighboring dischargers land in the same pixel area.

In FIG. 14, the horizontal axis represents the number of shut-off nozzles (liquid dischargers), i.e., the number of failed nozzles. The vertical axis represents the fraction ratio of the line head 10. Here, 'fraction ratio' is the probability of the generation of a pixel row that does not receive any ink droplets.

Figure 15:
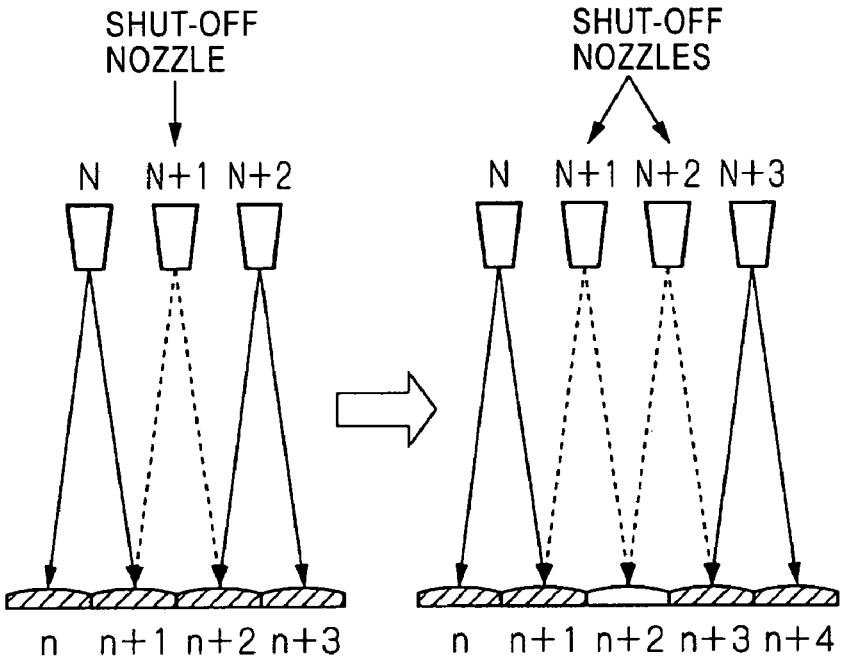
FIG. 15 illustrates the concept of the fraction ration represented by line ii in FIG. 14.

FIG. 15 illustrates the concept of a fraction ratio of line ii. When ink droplets discharged from nozzles of two neighboring liquid dischargers land at the same pixel area, ink droplets can be alternatively discharged from the normal nozzles N and N+2 disposed on both sides of the failed nozzle N+1 (center nozzle in the drawing), as shown in the left of FIG. 15. In other words, in this case, ink droplets cannot be discharged along the trajectory indicated by the dotted line but can be discharged along the trajectory indicated by the solid line in FIG. 15. As a result, ink droplets land in each pixel area n to n+3.

On the other hand, as shown at the right in FIG. 14, when nozzles N+1 and N+2 of two neighboring dischargers (disposed side by side) both fail, a pixel area that does not receive any ink droplets (pixel area n+2 in the drawing) appears even if the nozzles N and N+3 of the normal dischargers disposed on the outside of the failed nozzles alternatively discharge ink droplets. Line ii of FIG. 14 indicates the probability of two failed nozzles being disposed side by side when the number of failed nozzles increases.

Figure 16:
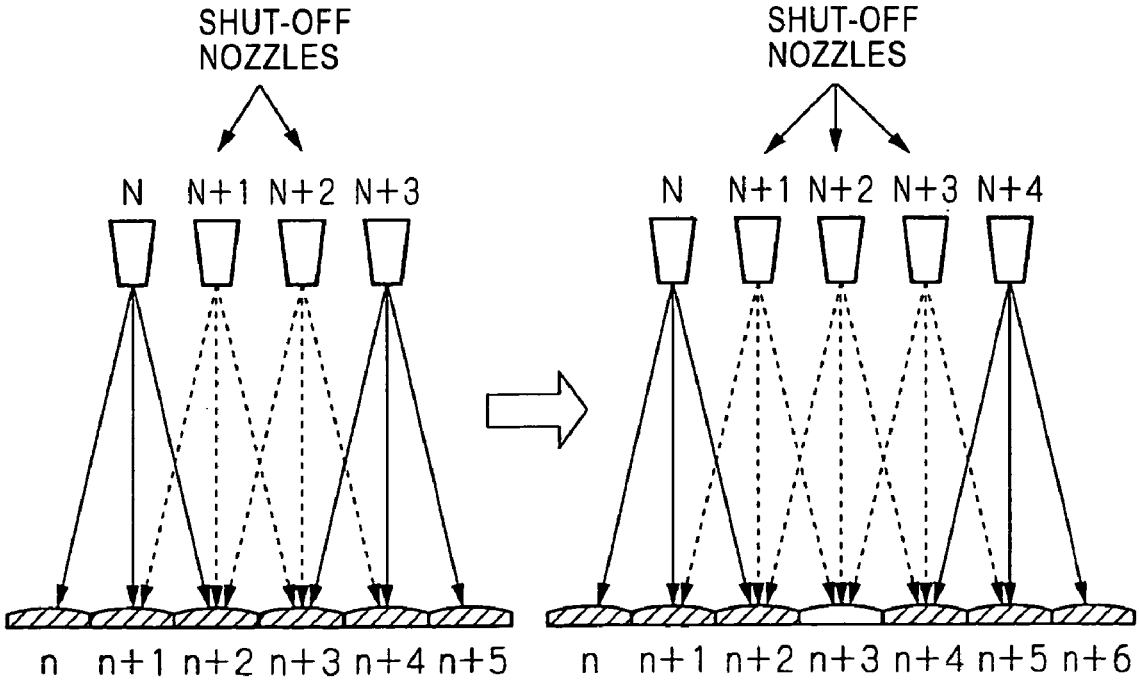
FIG. 16 illustrates the concept of the fraction ratio represented by line iii in FIG. 14.

Similarly, FIG. 16 illustrates the concept of the fraction ratio of line iii shown in FIG. 14. When ink droplets discharged from nozzles of three neighboring dischargers land at the same pixel area, ink droplets can be alternatively discharged from the normal nozzles N and N+3 disposed on the outside of the failed nozzles N+1 and N+2, as shown at the left in FIG. 16.

On the other hand, as shown at the right in FIG. 16, when nozzles N+1, N+2, and N+3 of three consecutive dischargers all fail, a pixel area that does not receive any ink droplets (pixel area n+3 in the drawing) appears even if the nozzles N and N+4 of the normal dischargers disposed on the outside of the failed nozzles alternatively discharge ink droplets. Line iii of FIG. 14 indicates the probability of three failed nozzles being disposed consecutively when the number of failed nozzles increases.

As shown in FIG. 14, in the case of line i in which alternative discharge is not performed, only the nozzle of one discharger fails, and, thus, ink droplets do not land at the pixel area this discharger is in charge of. Therefore, when the nozzle of one discharger fails, the fraction ratio of the line head 10 becomes 1.

On the other hand, if alternative discharge is performed as shown in FIG. 15, the fraction ratio of the line head 10 is greatly improved by two to three orders of magnitude, as shown by line ii in FIG. 14. In other words, this means the yield of the line head 10 is increased by 100 to 1,000 times.

In the case of line ii in FIG. 14, when there are about 70 failed nozzles, the fraction ratio becomes 1.

Embodiments of the present invention have been described in the above. The present invention, however, is not limited to these embodiments and variants such as the ones described below are possible.

(1) As an embodiment, a line head 10 (line printer) with heads 11 aligned in parallel over the width of the printing paper was described. The present invention, however, may be applied to a serial printer as well.

When the present invention is applied to a serial printer, one head 11 is used. While the head 11 is being moved across the width of the printing paper, it discharges ink droplets at the pixel area. Usually, while the head 11 is moving, the printing paper is not moved. Once printing is completed, the printing paper is fed in the direction perpendicular to the direction the head 11 moves and then the head 11 is moved across the width of the printing paper again.

When the present invention is applied to a serial printer, the head 11 is disposed so that the longitudinal direction of the head 11 is the same as the feeding direction of the printing paper. In other words, the direction of the head 11 is rotated by 90° compared to the heads 11 for the line head 10.

Thus, when the present invention is applied to a serial printer, the trajectories of the discharged ink droplets are deflected in the feeding direction of the printing paper since the head 11 is rotated by 90°.

For known serial printers, when a pixel row is not formed in the width direction of the printing paper, i.e., the direction the head 11 moves in, the missing pixel row appears as a line in the width direction of the printing paper (missing pixels in the feeding direction of the printing paper do not stand out). By performing alternative discharge according to the present invention, the number of lines formed due to missing pixel rows can be reduced.

(2) In the embodiments according to the present invention, the two parts composing a heat generation resistive element 13 are aligned in parallel. Electrical currents having different values are applied to each part to create a delay in the time required for each part to reach the ink boiling temperature (bubble generation time). The present invention, however, is not limited to this. Instead, the resistance of the two parts of the heat generation resistive element 13 can be set to the same value while electrical currents are applied to each of the two parts at different timing. For example, independent switches may be formed for each of the two parts of the heat generation resistive element 13. By turning each switch on at a different timing, an ink bubble forms on each part with a time lag. Moreover, the values of the electrical currents applied to the two parts of the heat generation resistive element 13 may be changed while the currents are applied to each part with a time lag.

(3) In the embodiments of the present invention, two parts composing a heat generation resistive element 13 are aligned in parallel inside one ink chamber 12. The present invention, however, is not limited to these embodiments and may include a heat generation resistive element 13 having three or more parts aligned in parallel inside one ink chamber 12.

(4) In the embodiments of the present invention, heat generation resistive elements 13 are disposed as liquid dischargers for a thermal printer. The present invention, however, is not limited to this and may be applied to electrostatic printers and piezoelectric printers.

An energizing element (equivalent to the heat generation resistive element 13) of the electrostatic printer is composed of a diaphragm and two electrodes disposed on the lower side of the diaphragm with an airspace interposed between the diaphragm and electrodes. A voltage is applied between the two electrodes to bend the diaphragm downwards. Then, the voltage is reduced to zero to release the electrostatic force. The elastic force generated when the diaphragm returns to its original position is used to discharge an ink droplet.

In this case, for example, to create a difference in the energy generated by each energizing element, a time lag is created between the two energizing elements or different voltages are applied to each energizing element when the diaphragm is returned to its original position (when the voltage is reduced to zero and the electrostatic force is released).

The energizing element for a piezoelectric printer is formed by stacking a piezoelectric element having electrodes on both sides, and a diaphragm. When a voltage is applied to the electrodes on both sides of the piezoelectric element, a bending moment is generated in the diaphragm due to the piezoelectric effect. As a result, the diaphragm bends and is deformed. Ink droplets are discharged when this deformation occurs.

In this case, similar to the above, to create a difference in the energy generated by each energizing element, a time lag is created between the two energizing elements or different voltages are applied to each energizing element.

(5) In the embodiments above, a printer was described as an embodiment of a liquid discharge apparatus. The present invention, however, is not limited to a printer and may be applied to various liquid discharge apparatuses. For example, the present invention may be applied to an apparatus for discharging solutions including DNA used for detecting biological specimens.

According to the present invention, even if some of the liquid dischargers fail to discharge droplets, this failure can be compensated for.

Thus, the effect of the failed dischargers is completely removed. Furthermore, even when there are failed liquid dischargers, which previously would have been diagnosed as a malfunction of the entire head, the function of the failed liquid discharger is compensated for. As a result, the maintenance period or the lifetime of the head can be extended.

What is claimed is:

1. A liquid discharge apparatus for relatively moving a recording medium and a head in a direction substantially perpendicular to a predetermined direction and for forming pixels composed of a predetermined number of dots disposed in pixel areas on the recording medium according to a liquid discharge signal during the relative movement, the liquid discharge apparatus comprising:

a head including a plurality of liquid dischargers having nozzles aligned in a predetermined direction;

a discharge deflecting unit capable of deflecting the trajectory of a droplet discharged from the liquid discharger with various amplitudes along the predetermined direction, the deflecting unit discharging droplets from at least two of the liquid dischargers in the vicinity onto the same pixel area, and discharging droplets from a liquid discharger selected from among the liquid dischargers capable of discharging droplets onto a pixel area for a pixel composed of a predetermined number of dots;

a storing unit for storing information on discharge failure, wherein the storing unit stores information on a liquid discharger shut-off due to discharge failure;

an alternative discharge unit for discharging droplets alternatively, wherein the alternative discharge unit transfers at least a part of a liquid discharge signal directed to the shut-off discharger to a free time slot, in which no discharge of droplets is commanded, of at least one of the other liquid dischargers according to the information stored in the storing unit and controls the liquid dischargers receiving the liquid discharge signal to discharge droplets onto the same landing position as the shut-off liquid discharger during the free time slot according to the transferred liquid discharge signal.

2. A liquid discharge apparatus according to claim 1, capable of discharging droplets onto a position $\pm(\frac{1}{2}\times P)\times N$ distant from the center of the liquid discharger in a predetermined direction, where N is a positive integer and P is the alignment pitch of the liquid dischargers in the alignment direction.

3. A liquid discharge apparatus according to claim 1, wherein liquid discharge signals for forming a dot row in the direction of the relative movement are sent one after another to at least two of the liquid dischargers capable of discharging droplets on a landing position corresponding to the liquid discharge signal, and wherein the dot row is formed by discharging droplets from at least two of the liquid dischargers in a predetermined direction according to the liquid discharge signals.

4. A liquid discharger according to claim 1, wherein the processing of a discharge signal for forming a dot row in the direction of relative movement is controlled by sharing the signal for selecting the liquid discharger and the signals for controlling the trajectory of the discharged droplet or by synchronizing one of the signals with the other signal.

5. A liquid discharge apparatus according to claim 1, wherein the generation of the liquid discharge signal for forming a dot row in the direction of the relative movement is controlled to generate a liquid discharge signal in a normal mode not involving the shut-off liquid discharger and a liquid discharge signal in a compensation mode involving the shut-off liquid discharger for transferring the liquid discharge signal to at least one of the other liquid dischargers disposed in the vicinity of the shut-off liquid discharger.

6. A liquid discharge apparatus according to claim 1, wherein the liquid discharge signals have time slots for the maximum number of discharge commands corresponding to one pixel area, and wherein the time slots for at least a portion of the discharge commands for the liquid discharge signal sent to the shut-off liquid discharger are added to the original time slots.

7. A liquid discharge apparatus according to claim 1, wherein the liquid discharge signals have time slots for the maximum number of discharge commands corresponding to one pixel area, wherein the time slots for at least a portion of the discharge commands for the liquid discharge signal sent to the shut-off liquid discharger are added to the original time slots, and wherein the speed of the relative movement is 1/(new pixel formation cycle/original pixel formation cycle).

8. A liquid discharge apparatus according to claim 1, wherein the disposition of the discharge commands to the time slots of the liquid discharge signal is controlled by taking a reference line close to the center of the time slot and allocating the discharge commands alternatively on both side of the reference line.

9. A method for discharging liquid through a head including a plurality of liquid dischargers having nozzles aligned in a predetermined direction, wherein the head is capable of deflecting the trajectory of a droplet discharged from the liquid discharger with various amplitudes along the predetermined direction and for discharging droplets from at least two of the liquid dischargers in the vicinity onto the same pixel area, the method comprising the steps of:

relatively moving a recording medium and the head in a direction substantially perpendicular to the predetermined direction, forming a pixel composed of a predetermine number of dots by discharging a predetermined number of droplets from the liquid dischargers during the relative movement, discharging droplets from at least two of the liquid dischargers in the vicinity onto the same pixel area, and for discharging droplets from a liquid discharger selected from among the liquid dischargers capable of discharging droplets onto a pixel area for a pixel composed of a predetermined number of dots, storing information on a shut-off discharger due to droplet discharge failure among the plurality of liquid dischargers, transferring at least a part of a liquid discharge signal directed to the shut-off discharger to a free time slot, where no discharger of droplets is commanded, for at least one of the other liquid dischargers according to the information stored in the storing unit, and controlling the liquid dischargers receiving the liquid discharge signal to discharge droplets onto the same landing position as the shut-off liquid discharger during the free time slot according to the transferred liquid discharge signal.

* * * * *